US005305727A

United States Patent [19]

Gopp

[11] Patent Number: 5,305,727

[45] Date of Patent: Apr. 26, 1994

[54] OXYGEN SENSOR MONITORING

[75] Inventor: Alexander Y. Gopp, Ann Arbor, Mich.

[73] Assignee: Ford Motor Company, Dearborn, Mich.

[21] Appl. No.: 891,086

[22] Filed: Jun. 1, 1992

[51] Int. Cl.[5] ..... F02D 41/14

[52] U.S. Cl. ..... 123/688

[58] Field of Search ..... 123/479, 688, 690; 73/118.1, 23.32; 60/274, 276, 277

[56] References Cited

U.S. PATENT DOCUMENTS

| | | | |
|---|---|---|---|
| 4,007,589 | 2/1977 | Neidhard et al. | 60/276 |
| 4,177,787 | 12/1979 | Hattori et al. | 123/198 D |
| 4,622,809 | 11/1986 | Abthoff et al. | 60/276 |
| 4,677,955 | 7/1987 | Takao | 123/688 |
| 5,020,499 | 6/1991 | Kojima | 123/479 |
| 5,048,490 | 9/1991 | Nakaniwa | 123/688 |
| 5,052,361 | 10/1991 | Ono | 123/688 |
| 5,095,743 | 3/1992 | Tomisawa | 73/118.1 |
| 5,125,384 | 6/1992 | Tada | 123/479 |

FOREIGN PATENT DOCUMENTS

| | | |
|---|---|---|
| 2735434 | 2/1978 | Fed. Rep. of Germany . |
| 0236207 | 2/1987 | France . |

*Primary Examiner*—Douglas Hart

*Attorney, Agent, or Firm*—Peter Abolins; Roger L. May

[57] ABSTRACT

An on-board oxygen sensor monitoring system includes measuring a first limit cycle of air/fuel controller operation, changing operating parameters of the air/fuel controller and measuring a second limit cycle with the new calibration of the controller. A time constant of the oxygen sensor is calculated as a function of the first and second limit cycle periods and compared to a maximum response rate.

9 Claims, 3 Drawing Sheets

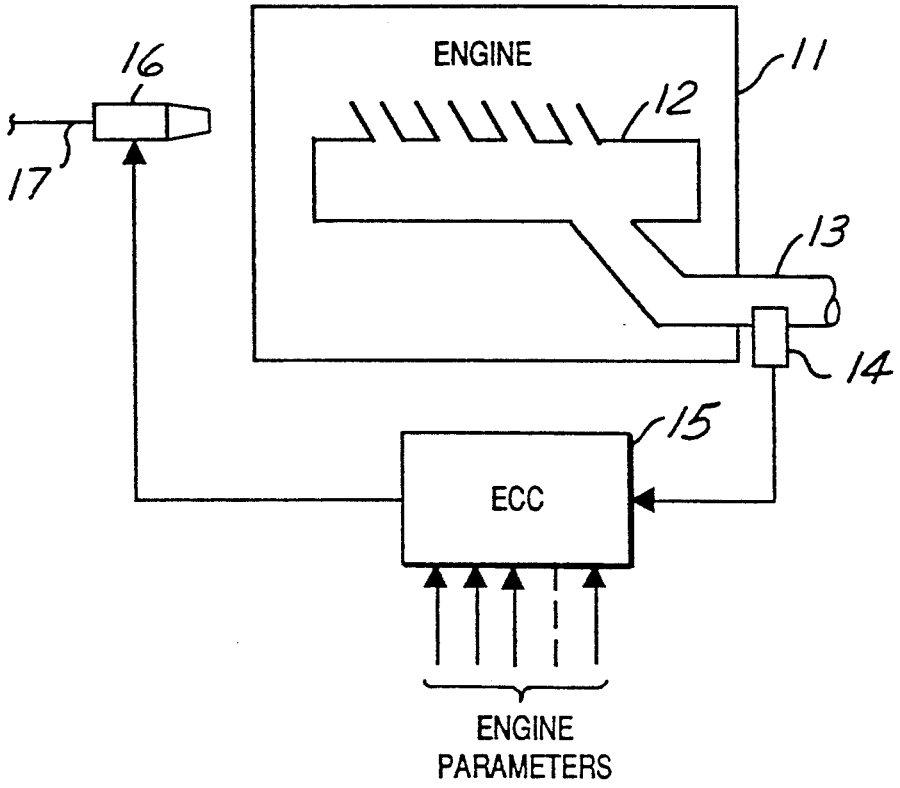
FIG. 1
FIG. 2
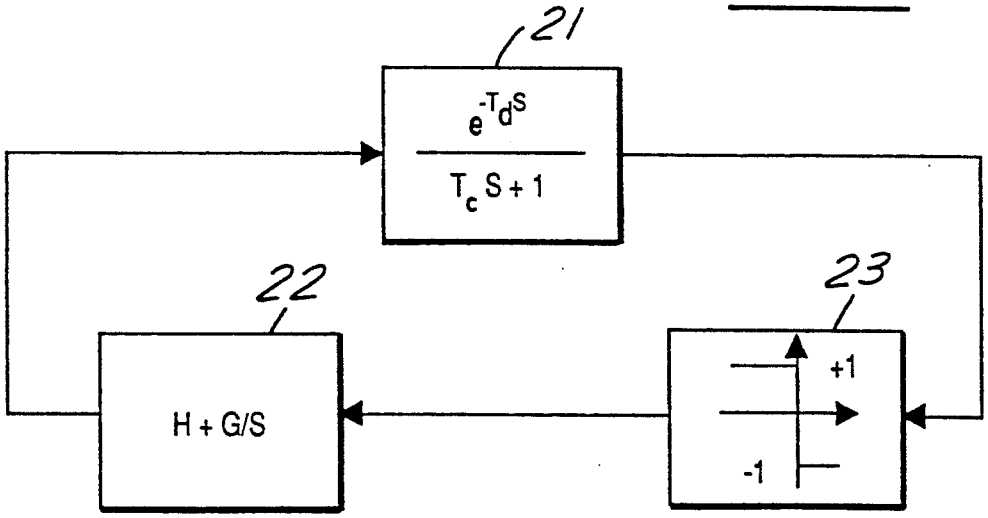

OXYGEN SENSOR MONITORING

BACKGROUND OF THE INVENTION

1. Field of the Invention

This invention relates to emission control of internal combustion engines. In particular, the invention relates to on-board monitoring of a primary fuel control oxygen (lambda or EGO) sensor for malfunction.

2. Prior Art

Various government regulations provide test conditions and monitoring methods for on-board monitoring of emission related devices. With respect to EGO sensor malfunction monitoring, the regulations suggest monitoring output voltage and response rate of the EGO sensors. Response rate is a time required for the EGO sensor to switch from lean to rich once it is exposed to a richer than stoichiometric exhaust gas or vice versa. A response rate check evaluates the portions of the sensor dynamic signal that are most affected by EGO sensor malfunctions such as aging, poisoning, or manufacturing deficiencies.

A deficiency of such methods is that during the test the fuel control system operates in an open loop control mode, and not a closed loop control made. As a result, air/fuel ratio tends to shift away from stoichiometry. Further, the particular selected air/fuel ratio swing and frequency greatly influence results of the test. The problem and disadvantages discussed above are overcome by this invention.

SUMMARY OF THE INVENTION

This invention provides a system for on-board oxygen sensor monitoring by measuring a sensor parameter during closed loop operation of the fuel control system. The parameter, a time constant $T_c$, is the equivalent to and the source of a limited sensor response rate. Thus, the invention provides a system for an alternative measurement of the EGO sensor response rate, and includes both a method and apparatus for EGO sensor monitoring employing an air/fuel ratio closed loop control system. The theoretical foundation of the method is as follows.

A vehicle exhaust system, having fuel as an input and exhaust gas oxygen concentration as an output, includes engine cylinders, an exhaust manifold, associated exhaust piping, and an EGO sensor located in piping after the exhaust manifold. In terms of a control system, a vehicle exhaust system may be described as a transport time delay $T_d$ and a first order low pass filter connected in series. The physical nature of the transport time dela $T_d$ is due to combustion time inside a combustion cylinder, combustion gas transport delay time between the cylinder and the EGO sensor through the exhaust manifold and the piping, and to a lesser extent the operating time of the processes in EGO sensor itself.

The first order low pass filter is specified by its time constant $T_c$ and is mainly due to an EGO sensor. The time constant $T_c$ is the only source for an EGO sensor response rate differing only in definitions of how it has been measured and interpreted. In a form of Laplace transform, a transfer function $W_e(s)$ of a vehicle exhaust system is $$W_e(s)=\exp(-T_d*s)/(-T_c*s+1) \quad \text{(Equation 1)}$$

A conventional air/fuel ratio controller is a proportional and integral (PI) controller with a gain H and integral G, commonly known in the field as a jumpback and ramp. Its transfer function $W_c(s)$ in a form of Laplace transform is $$W_c(s)=H+G/s \quad \text{(Equation 2)}$$

It should be mentioned that any more sophisticated controller, for example, a controller with a differential term may be used with the proposed method. A combined transfer function $W_s(s)$ of a series connection of engine exhaust system with EGO sensor and controller after obvious transformation may be presented in the form $$W_s(s)=\exp(-T_d*s)*(G/s+(H-G*T_c)/(T_c*s+1)) \quad \text{(Equation 3)}$$

EGO sensor output signal is connected to the PI controller input through a comparator, which has an output +1 or −1 depending upon to what side of a stoichiometric ratio of exhaust gases the EGO sensor is exposed. Closed loop air/fuel ratio control system operates in a limit cycle with a constant limit cycle period $T_L$. The limit cycle period $T_L$ is a function of exhaust system parameters: transport time delay $T_d$, and low pass filter time constant $T_c$, and controller parameters jumpback H and ramp G. An equation relating Period $T_L$ with these parameters is derived from Equation 3:

$$G*T_L/4-G*T_d+(H-G*T_c)*(1-(1-\text{th}(T_L/(4*T_c))*\exp(T_d/T_c))=0 \quad \text{(Equation 4)}$$

Equation 4 contains two unknown exhaust system and EGO sensor parameters $T_d$ and $T_c$, known PI controller parameters G and H, and a readily measurable vehicle limit cycle period $T_L$. In order to solve Equation 4 to find out unknown parameters $T_d$ and $T_c$, two equations like Equation 4 should be provided. To achieve this, the jumpback H or ramp G should be changed to produce the second limit cycle with another limit cycle period. Then two equations may be solved using any known numerical method to determine EGO sensor time constant $T_c$. For a good EGO sensor, such a time constant $T_c$, or response rate, is less than those a predetermined maximum response rate $T_{max}$.

In one particular aspect of the invention, the method includes the steps of: checking test entry conditions; measuring first limit cycle period with a standard air/fuel ratio PI controller parameters jumpback H and ramp G; changing one parameter such as jumpback value or both Parameters of said PI controller; measuring a second limit cycle period with a new parameters of said air/fuel ratio PI controller; solving a system of two equations relating said limit cycle periods to an EGO sensor time constant or response rate to find out said response rate; and comparing the found response rate to the maximum allowed response rate.

BRIEF DESCRIPTION OF THE DRAWINGS

The objects and advantages described herein will be more fully understood by reading the description of the preferred embodiment with references to the drawings wherein:

FIG. 1 is a schematic diagram of an internal combustion engine with a control system in accordance with an embodiment of this invention;

FIG. 2 is a block diagram of the control system in accordance with an embodiment of this invention.

DESCRIPTION OF THE PREFERRED EMBODIMENT

Figure 3A:
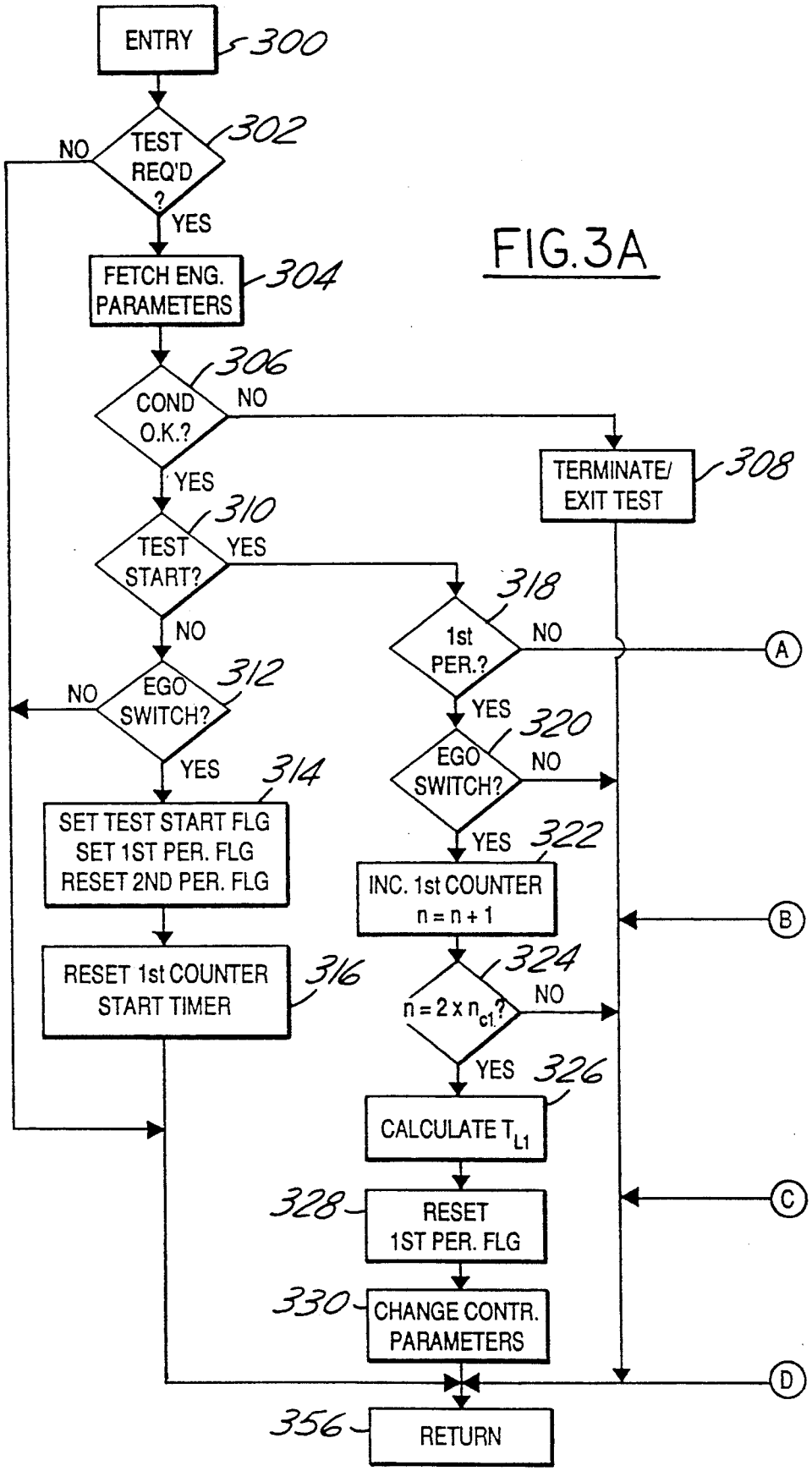
FIG. 3A, 3B is a flowchart illustrating various process steps performed to monitor EGO sensor and calculate response rate in accordance with an embodiment of this invention.

Referring to FIG. 1, an internal combustion engine 11 has exhaust gases from each of the combustion cylinders (not shown) routed to an exhaust manifold 12 and discharged through associated exhaust piping 13. Located in piping 13 near exhaust manifold 14 is an EGO sensor 14. An output signal of EGO sensor 14 is connected to an engine control computer (ECC) 15 which may be any conventional microcomputer capable of controlling air/fuel ratio of an engine. ECC 15 also receives different engine operating parameters which are used for operating engine 11. These parameters include, but are not limited to, engine and vehicle speed, air flow, crankshaft position, cooling water and inlet air temperatures.

Based on such engine operating parameters, ECC 15 calculates a fuel flow pulse width which is delivered to fuel injectors 16. Fuel is supplied to fuel injectors 16 through a fuel line 17. The fuel flow is further trimmed in accordance with the EGO input signal so that a limit cycle is initiated. Fuel flow calculations and air/fuel ratio correction are both obtained in conventional manner well known in the art.

It is noted that a majority of conventional engine components necessary for proper engine operations such as an ignition system is not shown for clarity. Those skilled in the art will also recognize that the invention may be used to advantage with engines having different number of cylinders or fuel injectors. Referring to the block diagram of the control system in FIG. 2, block 21 refers to a vehicle exhaust system and EGO sensor described by Equation 1, block 22 refers to a PI controller described by Equation 2, and block 23 refers to a comparator. Corresponding transfer functions and schematic representation of the comparator are also shown in FIG. 2.

Figure 3B:
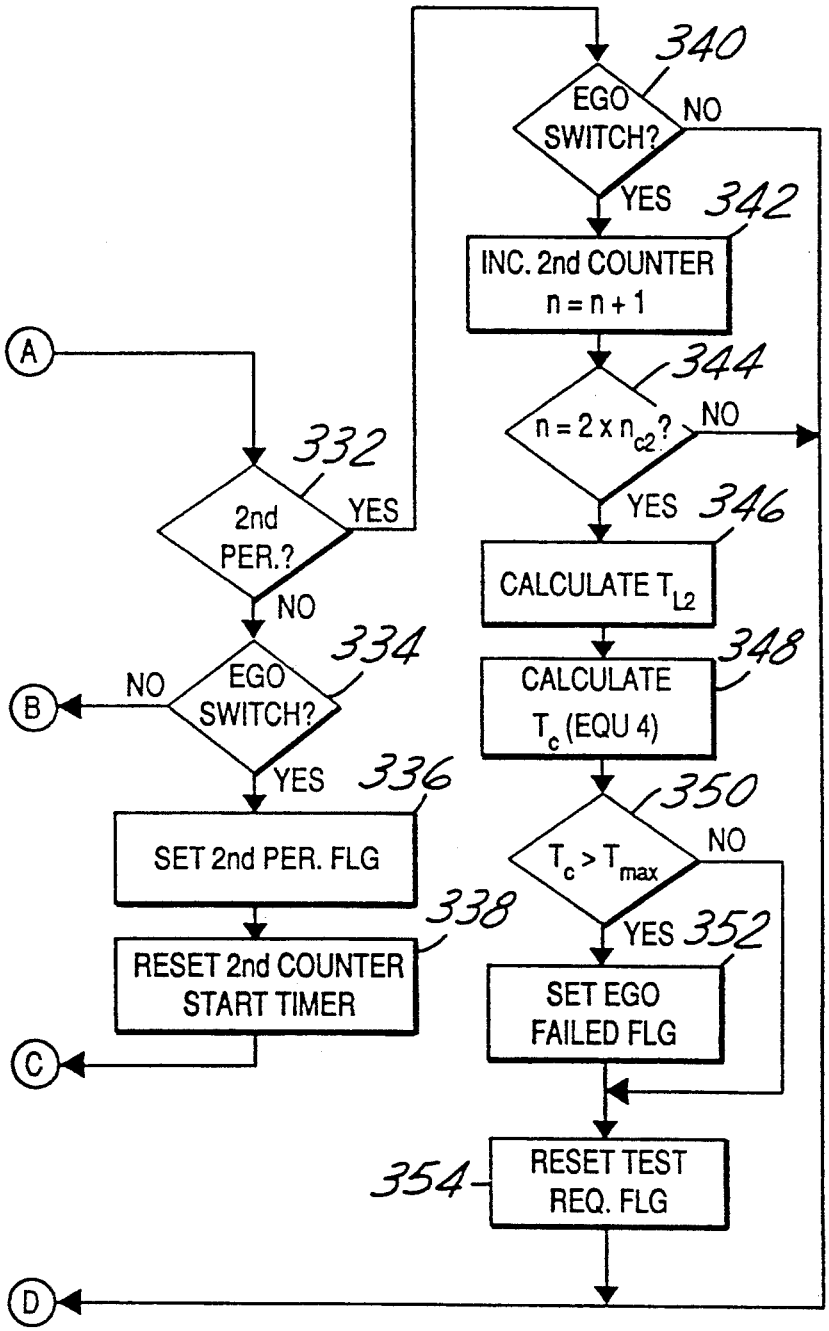

The operation of ECC 15 in controlling air/fuel ratio and monitoring the EGO sensor is described in the flowchart shown in FIG. 3. At the start of each sampling interval, a main routine executed by ECC 15 enters an EGO monitoring subroutine in step 300. It is assumed in the description, that the microcomputer operates with a variable sampling interval. Otherwise, if the interval is constant, for example, 10 msec, a simple counter may be used instead of a timer as described below. If it is desired to perform only one test per trip, in step 302 a flag is checked to determine if an EGO test has already been performed. If a test is not required, the subroutine is exited in step 356. If a test is required, it proceeds to step 304, where engine operating parameters are acquired. If desired, EGO monitoring is performed at specified vehicle conditions such as relatively constant vehicle speed and engine load, closed loop fuel control, and the like. These conditions are verified in step 306. If such conditions are not satisfied, step 308 terminates the test. Otherwise, the EGO monitoring subroutine proceeds to step 310.

Steps 310, 312, 314 and 316 prepare different flags, a timer, and a counter for measuring the first limit cycle period. First, if the test has not been started (Test Start flag in step 310 is reset), a subroutine exits in step 312 until a first EGO switch. After the first EGO switch is detected in step 312, subroutine proceeds to step 314. Step 314 sets the Test Start flag, used in step 310, sets 1st period flag for use in step 318, and resets 2nd Period flag for use in step 332. Then step 316 resets 1st period counter for step 322 (n=0), and starts the test timer (not shown). Both the timer and counter are used to measure an average value of the first limit cycle period $T_{L1}$.

At the next sampling interval, the subroutine proceeds after step 310 to step 318, and then waits for an EGO switch in step 320. The 1st Period counter is incremented in step 322 each time EGO switches in step 320. When counter 322 reaches $n=2 * n_{cl}$ counts in step 324, where $n_{cl}$ is a preset number of limit cycles to be averaged, for example, $n_{cl}=5$, step 326 reads an elapsed time from the timer (not shown), calculates the first limit cycle period $T_{L1}$, and stores its value in memory. Step 328 resets the 1st Period flag used in step 318. Those skilled in the art can modify the flowchart in such a way that it uses preset time instead of preset counts to average the limit cycle period.

In step 330, PI controller parameters are changed to initiate a second limit cycle. Either one parameter, jumpback H or ramp H, or both simultaneously may be changed to achieve this effect. After PI controller parameters have been changed in step 330, the subroutine in the next sampling interval proceeds through steps 310 and 318 to step 332. Steps 332, 334, 336, and 338 prepare different flags, a timer, and a counter for measuring second limit cycle period. These steps are similar to above described steps 310, 312, 314, and 316. First, if second limit cycle measurement has not been started yet (2nd Period flag in step 332 is reset) a subroutine exits in step 334 until the next EGO switch. After EGO switch is detected in step 334, the subroutine proceeds to step 336, which sets the 2nd Period flag used in step 332. Then step 338 resets the 2nd period counter for step 342 (n=0), and restarts the test timer. Both the timer and counter are used to measure an average value of the second limit cycle period $T_{L2}$.

At the next sampling interval, the subroutine proceeds after steps 310, 318, and 332 to step 340. Steps 340, 342, 344, and 346 are similar to steps 320, 322, 324, and 326 and provide measurement of the second limit cycle period $T_{L2}$. The subroutine waits for EGO switch in step 340, and increments the 2nd Period counter in step 342 each time EGO switches in step 340. When counter 342 reaches $n=2 * n_{c2}$ counts in step 344, where $n_{c2}$ is a preset number of limit cycles to be averaged, step 346 reads an elapsed time from the timer (not shown) and calculates the second limit cycle period $T_{L2}$.

Both measured values of $T_{L1}$ and $T_{L2}$ are used to calculate values of transport time dela $T_d$ and filter time constant $T_c$ from a set of two equations based on Equation 4 in step 348. Step 350 checks if the calculated value of $T_c$ exceeds the maximum value $T_{max}$, and if so, step 352 sets the EGO failure flag. Then step 354 resets the test required flag indicating that EGO monitoring test is complete.

This concludes the description of the preferred embodiment. The reading of it by those skilled in the art will bring to mind many further alterations and modifications without departing from the spirit and scope of the invention. Accordingly, it is intended that the scope of the invention be limited to only the following claims.

What is claimed:

1. A method for monitoring an internal combustion engine on-board oxygen sensor, said engine having exhaust means, an exhaust gas oxygen (EGO) sensor associated with the exhaust means and an air/fuel ratio controller for controlling operation of the engine, said method including the steps:

determining test entry conditions;

measuring a first limit cycle period with a first calibration of said air/fuel ratio controller;

generating a signal which represents an average of said first limit cycle period;

changing parameters of said air/fuel ratio controller to a second calibration and initiating a second limit cycle with a different limit cycle period;

measuring a second limit cycle period with the second calibration of said air/fuel ratio controller;

generating a signal which represents an average of said second limit cycle period;

calculating a time constant of said EGO sensor as a function of said first and second limit cycle periods;

generating a signal representing said time constant;

comparing said signal representing said time constant with a predetermined maximum allowed response rate; and generating a signal indicating a failed EGO sensor if said time constant si greater than said maximum allowed response rate.

2. A method for monitoring an internal combustion engine on-board oxygen sensor including the steps of:

determining test entry conditions;

determining whether a test using a test routine is required;

if a test routine required, determining engine operating parameters;

determining whether the engine operating parameters are within predetermined limits;

if the engine operating parameters are not within predetermined limits terminating the test and exiting the test routine;

if the engine operating parameters are within predetermined limits determining whether or not to start the test;

if the test is started, determining whether there is a first period if not, determining whether there is a second period, if not determining whether there is EGO switching, if not returning to the start of the test;

if there is EGO switching setting a second period;

resetting a count start timer; returning to the start of the test; if there is a second period determining whether there is EGO switching, if not returning to the start of the test; if yes, incrementing a count so that $N=N+1$; comparing the value of N to twice a preset second number of limit cycles, if it is not equal, returning to the start of the test, if it is equal calculating a second limit cycle period;

generating a signal representing said second limit cycle period;

calculating a filter time constant, $T_c$;

generating a signal representing said filter time constant;

checking said signal representing the filter time constant $T_c$ against a maximum time constant;

if the signal representing $T_c$ is not larger, resetting a test required flag;

if it is larger, generating a signal indicating a failed EGO sensor and then resetting the test required flag;

if the first period determination is yes, checking to see if there is EGO switching, if not returning to the start of the test, if yes, incrementing the count so that $N=N+1$ and comparing N to twice a preset first number of limit cycles;

if the comparison is not equal, returning to the start of the test;

if the comparison is equal calculating a first limit cycle $T_{L1}$;

generating a signal representing said first limit cycle $T_{L1}$:

resetting a first period flag;

changing engine operating control parameters;

returning to the start of the test;

if the test is not started checking to see if there is EGO switching if not returning to the start of the test; if there is EGO switching setting a test flag, a first period flag, and resetting a second period flag;

resetting a count start timer; and returning to the start of the test.

3. A method for monitoring an internal combustion engine on board oxygen sensor, said engine having exhaust means, an exhaust gas oxygen (EGO) sensor associated with the exhaust means, and air fuel ratio controller for controlling operation of the engine, said method including the steps of:

determining if a test is required;

if not, exiting from a test routine;

if yes, determining engine operating parameters;

determining if the engine operating parameters are satisfactory; if not terminating the test; if yes, determining whether a test has been started;

if not determining if there has been EGO switching;

if yes looking at a setting of a first period flag;

if there has been no EGO switching exiting from the test;

if there has been EGO switching setting a test start flag, setting a first period flag and resetting a second period flag;

resetting a counter and starting a timer;

exiting from the sequence;

if the test has been started, investigating whether the first period flag has been set;

if yes determining whether there was EGO switching;

if yes incrementing the first counter so that $n=n+1$;

determining if n is equal to twice a first number of limit cycles;

if yes calculating a first limit cycle period and generating a signal representing said first limit cycle period;

resetting the first period flag;

changing the controller parameters; and exiting from the routine.

4. A method for monitoring an internal combustion engine on board oxygen sensor as recited in claim 3 further comprising the steps of:

if the first period flag is not set, checking to see whether a second period flag had been set;

if the EGO sensor has not switched exiting from the routine;

if n does not equal twice the first number of limit cycles exiting from the routine;

if the second period flag has not been set, checking to see if there is EGO switching, if there has not been EGO switching exiting from the routine;

if there has been EGO switching, setting a second period flag;

resetting the second counter and starting the timer; and exiting from the test routine.

5. A method for monitoring an internal combustion engine on board oxygen sensor as recited in claim 4 further comprising the steps of:

if the second period flag has been set, checking to see if there was EGO switching;

if not, exiting from the routine;

if yes, incrementing the second counter so that $N=N+1$;

checking to see if N equals twice a present second number of limit cycles;

if not, exiting the test routine;

if yes, calculating a second limit cycle period and generating a signal representing said second limit cycle period;

calculating a filter time constant $T_c$;

generating a signal representing $T_c$;

determining whether said signal representing $T_c$ is greater than a maximum time constant $T_{max}$;

if yes, generating a signal indicating EGO failed;

if no, resetting a test required flag; and exiting from the test routine.

6. An apparatus for monitoring an internal combustion engine on-board oxygen sensor, the engine having exhaust means, an exhaust gas oxygen (EGO) sensor associated with the exhaust means and an air/fuel ratio controller for controlling operation of the engine, said apparatus including:

means for determining test entry conditions;

means for measuring a first limit cycle period with a first calibration of said air/fuel ratio controller; 'means for generating a signal representing the average of said first limit cycle period;

means for changing parameters of said air/fuel ratio controller to a second calibration and initiating a second limit cycle with a different limit cycle period;

means for measuring the second limit cycle period with the second calibration of said air/fuel ratio controller;

means for generating a signal representing the average of said second limit cycle period;

means for calculating a time constant of said oxygen sensor;

means for generating a signal representing said time constant;

means for comparing said signal representing said time constant with the maximum allowed response rate; and means for generating a signal indicating oxygen sensor failure if said signal representing said time constant is greater than said maximum allowed response rate.

7. Apparatus for monitoring an internal combustion engine on board oxygen sensor, said engine having an exhaust means, an exhaust gas oxygen (EGO) sensor associated with the exhaust means, and air fuel ratio controller for controlling operation of the engine, said apparatus including:

means for determining if a test is required;

means for exiting from a test routine if a test is not required;

means for determining engine operating parameters if a test is required;

means for determining if the engine operating parameters are satisfactory; means for terminating the test if the engine operating parameters are not satisfactory; means for determining whether a test has been started if the engine operating parameters are satisfactory;

means for determining if there has been EGO switching if a test has been started;

means for looking at a setting of a first period flag if there has been EGO switching;

means for exiting from the test if there has been no EGO switching;

means for setting a test start flag, setting a first period flag and resetting a second period flag, if there has been EGO switching;

means for resetting a counter and starting a timer;

means for exiting from the sequence;

means for investigating whether the first period flag has been set if the test has been started;

means for determining whether there was EGO switching if the first period flag has been set;

means for incrementing the first counter so that $n=n+1$ if there was EGO switching;

means for determining if n is equal to twice a first number of limit cycles;

means for calculating a first limit cycle period if n is equal to twice the first number of limit cycles;

means for generating a signal representing said first limit cycle period;

means for resetting the first period flag;

means for changing the controller parameters; and means for exiting from the routine.

8. An apparatus for monitoring an internal combustion engine on board oxygen sensor as recited in claim 7 further comprising:

means for checking to see whether a second period flag has been set if the first period flag is not set;

means for exiting from the routine if the EGO sensor has not switched;

means for exiting from the routine if n does not equal twice the first number of limit cycles;

means for checking to see if there is EGO switching if the second period flag has not been set; means for exiting from the routine if there has not been EGO switching;

means for setting a second period flag if there has been EGO switching;

means for resetting the second counter and starting the timer; and means for exiting from the test routine.

9. An apparatus for monitoring an internal combustion engine on board oxygen sensor as recited in claim 8 further comprising:

means for checking to see if there was EGO switching if the second period flag has been set;

means for exiting from the routine if the second period flag has not been set;

means for incrementing the second counter so that $N=N+1$ if the second period flag has been set;

means for checking to see if N equals twice a preset second number of limit cycles;

means for exiting the test routine if N does not equal twice the second preset number of limit cycles;

means for calculating a second limit cycle period if N equals twice the second preset number of limit cycles;

means for generating a signal representing said second limit cycle period;

means for calculating the EGO sensor's filter time constant $T_c$;

means for generating a signal representing said filter time constant $T_c$;

means for determining whether said signal representing $T_c$ is greater than a maximum time constant;

means for generating a signal indicating EGO failure if $T_c$ is greater than the maximum time constant;

means for resetting the test required flag if $T_c$ is not greater than the maximum time constant; and means for exiting from the test routine.

* * * * *